US006236285B1

(12) United States Patent
Konishi et al.

(10) Patent No.: US 6,236,285 B1
(45) Date of Patent: May 22, 2001

(54) LUMPED ELEMENT CIRCULATOR HAVING A PLURALITY OF SEPARATED OPERATION BANDS

(75) Inventors: Yoshihiro Konishi, Kanagawa; Taro Miura, Tokyo; Akira Usami; Yoshifumi Misu, both of Chiba, all of (JP)

(73) Assignees: K Laboratory Co., Kanagawa; TDK Corporation, Tokyo, both of (JP)

( * ) Notice: Subject to any disclaimer, the term of this patent is extended or adjusted under 35 U.S.C. 154(b) by 0 days.

(21) Appl. No.: 09/148,318

(22) Filed: Sep. 4, 1998

(30) Foreign Application Priority Data

Sep. 17, 1997 (JP) ..... 9-269211

(51) Int. Cl.[7] ..... H01P 1/383
(52) U.S. Cl. ..... 333/1.1; 333/167
(58) Field of Search ..... 333/1.1

(56) References Cited

U.S. PATENT DOCUMENTS 3,818,381 * 6/1974 Konishi et al. ..... 333/1.1

FOREIGN PATENT DOCUMENTS

2671912 * 7/1992 (FR) ..... 333/1.1
56-24815 * 3/1981 (JP) ..... 333/1.1
10-107509 4/1998 (JP) .
1334224 * 8/1987 (SU) ..... 333/1.1

OTHER PUBLICATIONS

"Lumped Element Y Circulator", Konishi, *IEEE Transactions on Microwave Theory and Techniques,* vol. MTT–13, No. 6, Nov. 1965, pp. 852–864.
"Proposed Dual Band Lumped Element Y Circulator", Konishi, *Microwave and Optical Technology Letters,* vol. 17, No. 1, 1998, pp. 13–16.

* cited by examiner

*Primary Examiner*—Paul Gensler
(74) *Attorney, Agent, or Firm*—Arent Fox Kintner Plotkin & Kahn, PLLC

(57) ABSTRACT

A lumped element circulator having a plurality of operation bands, has a circulator element with a plurality of signal ports and a grounded terminal, and resonance circuits connected between the signal ports and the grounded terminal, respectively, each of the resonance circuits having a plurality of resonance points. The number of the operation bands is equal to the number of the resonance points of each of the resonance circuits.

3 Claims, 7 Drawing Sheets

LUMPED ELEMENT CIRCULATOR HAVING A PLURALITY OF SEPARATED OPERATION BANDS

FIELD OF THE INVENTION

The present invention relates to a lumped element circulator used as a high frequency circuit element in for example a portable or mobile communication equipment. Particularly, the present invention relates to a lumped element circulator operable in a plurality of frequency bands.

DESCRIPTION OF THE RELATED ART

A circulator is an element for giving non-reciprocal characteristics to a high frequency circuit so as to suppress reflecting waves in the circuit. Thus, standing waves can be prevented from generation resulting that stable operations of the high frequency circuit can be expected. Therefore, in recent portable telephones, such non-reciprocal elements are usually provided for suppress standing waves from generation.

Recently, demand for a portable telephone capable of operating in a plurality of different frequency bands (multi-bands telephone) has been increased in order to enable effective use of the portable telephone. However, the conventional circulator can be operated in only one frequency band. Thus, in order to operate in a plurality of frequency bands, it is necessary (A) to broaden the frequency bandwidth of the single band circulator by using an impedance matching circuit, or (B) to combine a plurality of single band circulators with a band-pass filter for individually operating the circulators.

According to the above-mentioned solution (A) where the frequency bandwidth of the single band circulator is broadened, a sufficiently wide bandwidth cannot be expected but only about 30% of the center frequency can be broadened. Thus, as for a recent dual band portable telephone operable at dual frequencies which differ twice with each other, the solution (A) cannot be adopted.

According to the solution (B) where a plurality of single band circulators operating at different frequency bands are connected in parallel and are selected by filters and switching means, the dimension of the combined circuit becomes large. In addition, the impedance characteristics out of the bandwidths of the circulators interfere with each other causing the operating characteristics to become unstable.

SUMMARY OF THE INVENTION

It is therefore an object of the present invention to provide a lumped element circulator which alone can suppress standing waves from generation in a plurality of frequency bands.

According to the present invention, a lumped element circulator having a plurality of operation bands, has a circulator element with a plurality of signal ports and a grounded terminal, and resonance circuits connected between the signal ports and the grounded terminal, respectively, each of the resonance circuits having a plurality of resonance points. The number of the operation bands is equal to the number of the resonance points of each of the resonance circuits.

The invention focuses attention on that, in a lumped element circulator, difference between eigenvalues of the circulator element excited by positive and negative rotational eigenvectors is 120 degrees (in case of three port circulator) without reference to frequency. Thus, according to the invention, a network exhibiting a frequency performance for satisfying circulator conditions in a plurality of necessary frequency bands is connected to each port so that the circulator can operate in the plurality of frequency bands. This is realized by inserting a resonance circuit having a plurality of resonance points between each of the signal ports and the grounded terminal of the circulator element of the lumped element circulator.

As a result, according to the invention, a lumped element circulator alone can suppress any standing wave from generation in a plurality of frequency bands. Thus, in a high frequency circuit in a telephone which operates in a plurality of frequency bands such as a dual band telephone, the circulator according to the present invention can be alone used to suppress standing wave from generation in a plurality of frequency bands.

It is preferred that each of the resonance circuits is a series-parallel resonance circuit having at least one pair of a series resonance point and a parallel resonance point.

It is also preferred that the number of the operation bands is equal to the number of the pair of the series resonance point and the parallel resonance point plus one.

Further objects and advantages of the present invention will be apparent from the following description of the preferred embodiments of the invention as illustrated in the accompanying drawings.

DESCRIPTION OF THE PREFERRED EMBODIMENTS

Figure 1:
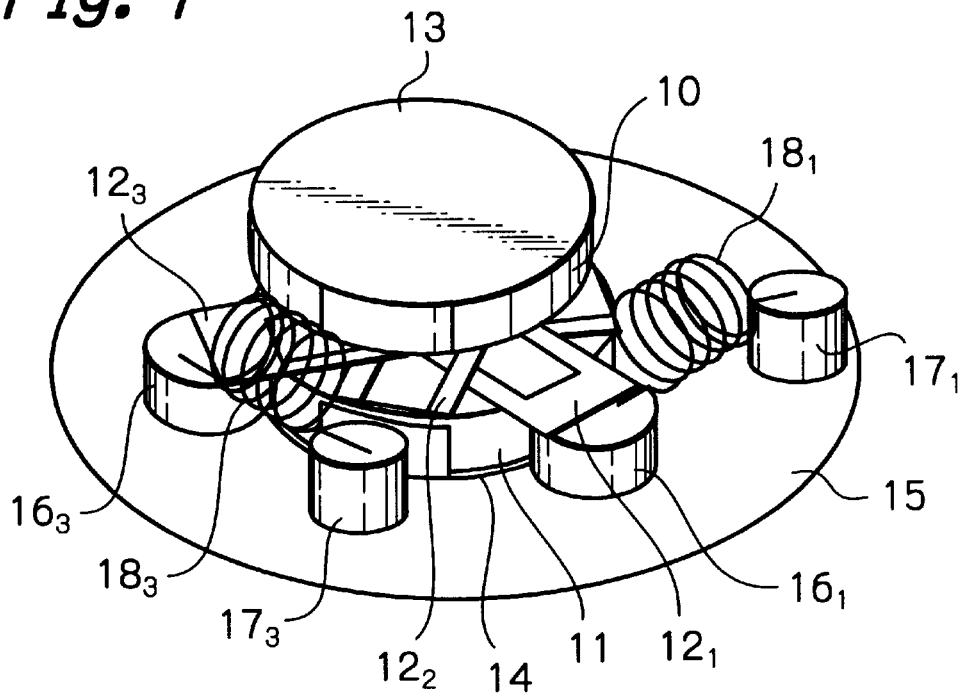
FIG. 1 shows an oblique view schematically illustrating a structure of a dual band lumped element circulator of a preferred embodiment according to the present invention.

FIG. 1 schematically illustrates a structure of a three port type dual band lumped element circulator of a preferred embodiment according to the present invention.

In the figure, reference numerals 10 and 11 denote integrated ferromagnetic material disks, made of for example ferrite, sandwiching three pairs of two parallel drive conductors $\mathbf{12}_1$, $\mathbf{12}_2$ and $\mathbf{12}_3$ which are insulated from each other, 13 and 14 denote shielding electrodes formed on outer surfaces of the respective ferromagnetic material disks 10 and 11, 15 denotes a grounded electrode, $\mathbf{16}_1$, $\mathbf{17}_1$, $\mathbf{16}_3$ and $\mathbf{17}_3$ denote resonance capacitors, and $\mathbf{18}_1$ and $\mathbf{18}_3$ denote resonance coils, respectively. The pairs of drive conductors $\mathbf{12}_1$, $\mathbf{12}_2$ and $\mathbf{12}_3$ constitute three inductors which extend to three directions 120 degrees apart and form a trigonally symmetric shape.

The resonance capacitor $\mathbf{17}_1$ and the resonance coil $\mathbf{18}_1$ constitute a series resonance circuit. This series resonance circuit and the resonance capacitor $\mathbf{16}_1$ are connected in parallel between the signal port of the drive conductor pair $\mathbf{12}_1$ and the grounded electrode 15. Similar to this, the resonance capacitor $\mathbf{17}_3$ and the resonance coil $\mathbf{18}_3$ constitute a series resonance circuit. This series resonance circuit and the resonance capacitor $\mathbf{16}_3$ are connected in parallel between the signal port of the drive conductor pair $\mathbf{12}_3$ and the grounded electrode 15. Although it is hidden in FIG. 1, a series resonance circuit which is constituted by the resonance capacitor $\mathbf{17}_2$ and the resonance coil $\mathbf{18}_2$, and the resonance capacitor $\mathbf{16}_2$ (FIG. 2) are connected in parallel between the signal port of the drive conductor pair $\mathbf{12}_2$ and the grounded electrode 15. Excitation permanent magnets (not shown) are provided on the element 10 and under the element 11, respectively.

Figure 2:
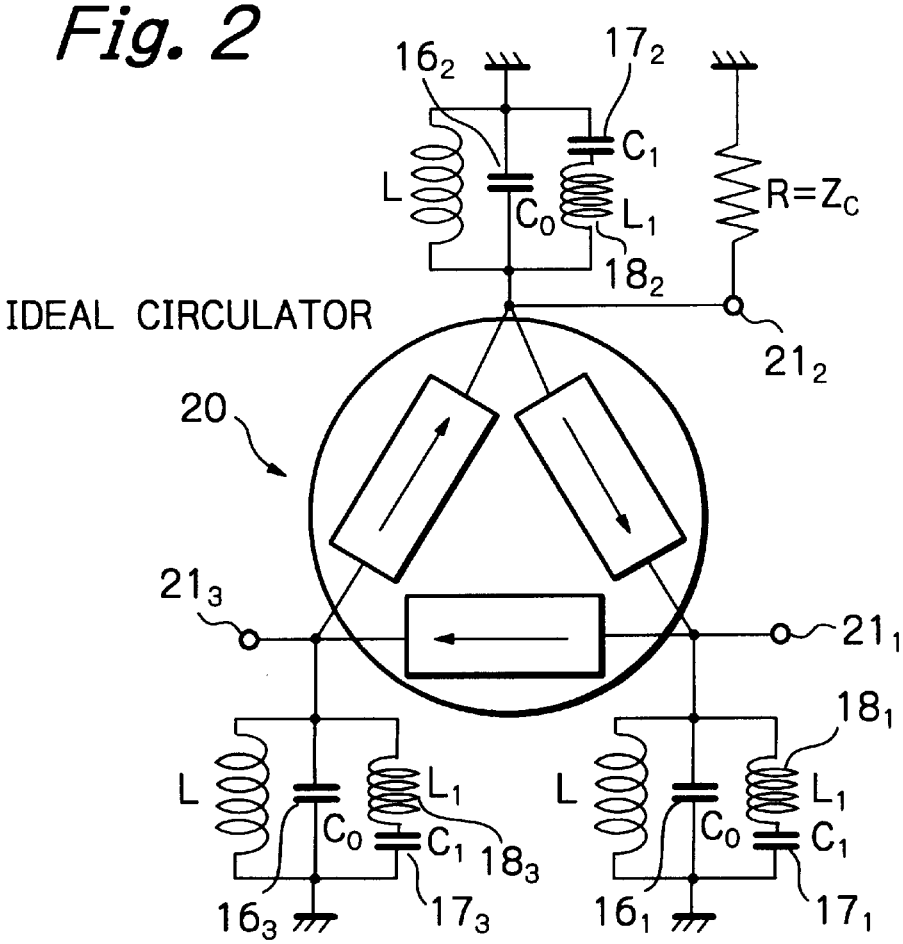
FIG. 2 shows an equivalent circuit diagram of the lumped element circulator of the embodiment shown in FIG. 1.

An equivalent circuit of the lumped element circulator of the embodiment of FIG. 1 is illustrated in FIG. 2. As will be understood from this figure, this lumped (element circulator is equivalent to a circuit in which, between signal ports $\mathbf{21}_1$, $\mathbf{21}_2$ and $\mathbf{21}_3$ of an ideal circulator 20 and the grounded electrode 15, a series-parallel resonance circuit constituted by the resonance capacitor $\mathbf{16}_1$ with a capacitance $C_0$, the resonance capacitor $\mathbf{17}_1$ with a capacitance $C_1$, the resonance coil $\mathbf{18}_1$ with an inductance $L_1$ and an inductor L, a series-parallel resonance circuit constituted by the resonance capacitor $\mathbf{16}_2$ with a capacitance $C_0$, the resonance capacitor $\mathbf{17}_2$ with a capacitance $C_1$, the resonance coil $\mathbf{18}_2$ with an inductance $L_1$ and an inductor L, and a series-parallel resonance circuit constituted by the resonance capacitor $\mathbf{16}_3$ with a capacitance $C_0$, the resonance capacitor $\mathbf{17}_3$ with a capacitance $C_1$, the resonance coil $\mathbf{18}_3$ with an inductance $L_1$ and an inductor L are connected, respectively. The ideal circulator 20 is a virtual circuit element operating as a circulator over whole range from zero frequency to infinite frequency. The circuit composed of this ideal circulator 20 and the inductors L corresponds to non-reciprocal inductance of the meshed drive conductors $\mathbf{12}_1$, $\mathbf{12}_2$ and $\mathbf{12}_3$ constructed in the circulator element.

According to the lumped element circulator of this embodiment, instead of a capacitor, the resonance circuit providing a necessary effective capacitance at required frequencies is connected between each of the signal ports $\mathbf{21}_1$, $\mathbf{21}_2$ and $\mathbf{21}_3$ and the grounded electrode 15. Thus, this lumped element circulator can operate as a circulator in a plurality of frequency bands, as described hereinafter in detail.

Figure 3:
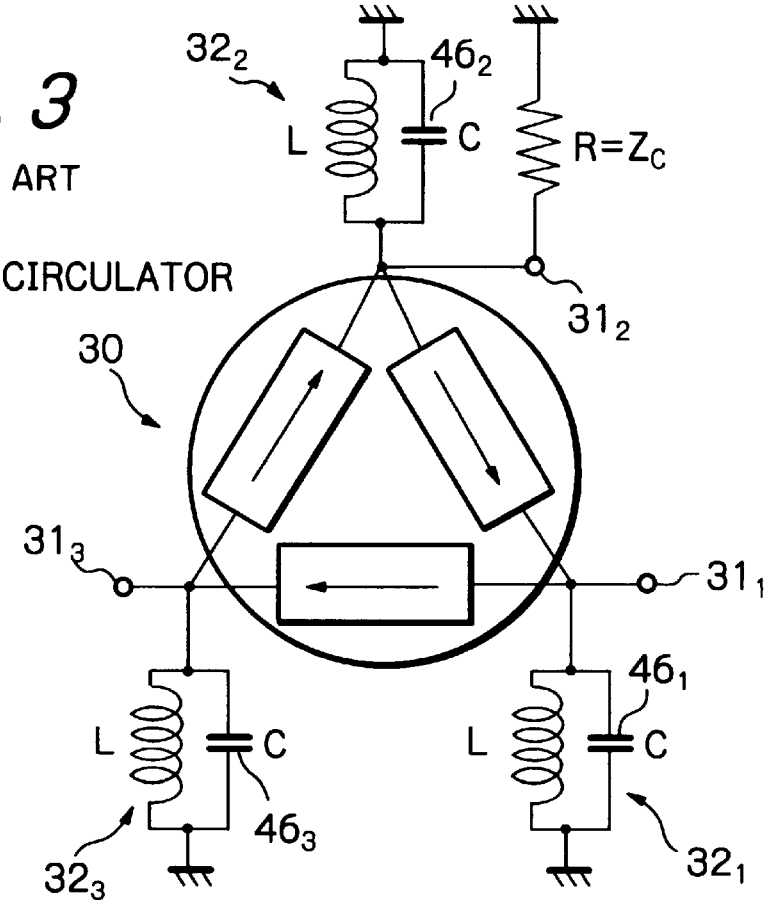
Fig. 3 PRIOR ART
FIG. 3 shows an equivalent circuit diagram of a conventional lumped element circulator.

An equivalent circuit of a conventional lumped element circulator is illustrated in FIG. 3. As shown in this figure, the conventional lumped element circulator is equivalent to a circuit in which parallel resonance circuits $\mathbf{32}_1$, $\mathbf{32}_2$ and $\mathbf{32}_3$ with a center frequency $f_0$ are connected to signal ports $\mathbf{31}_1$, $\mathbf{31}_2$ and $\mathbf{31}_3$ of an ideal circulator 30, respectively. The ideal circulator 30 is a virtual circuit element operating as a circulator over whole range from zero frequency to infinite frequency. The circuit composed of this ideal circulator 30 and inductors L in the parallel resonance circuits $\mathbf{32}_1$, $\mathbf{32}_2$ and $\mathbf{32}_3$ corresponds to non-reciprocal inductance of meshed drive conductors constructed in a circulator element of the conventional lumped element circulator.

Figure 4A:
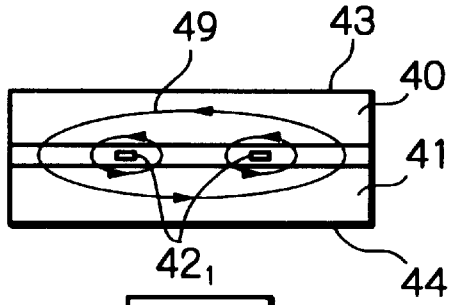
Fig. 4a PRIOR ART
FIGS. 4*a* and 4*b* show a sectional view and a top view illustrating a structure of an inductor part of the conventional lumped element circulator.
Figure 4B:
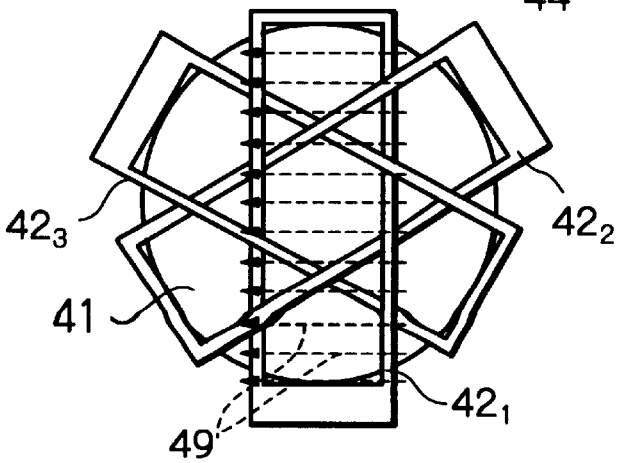
Fig. 4b PRIOR ART
Figure 5:
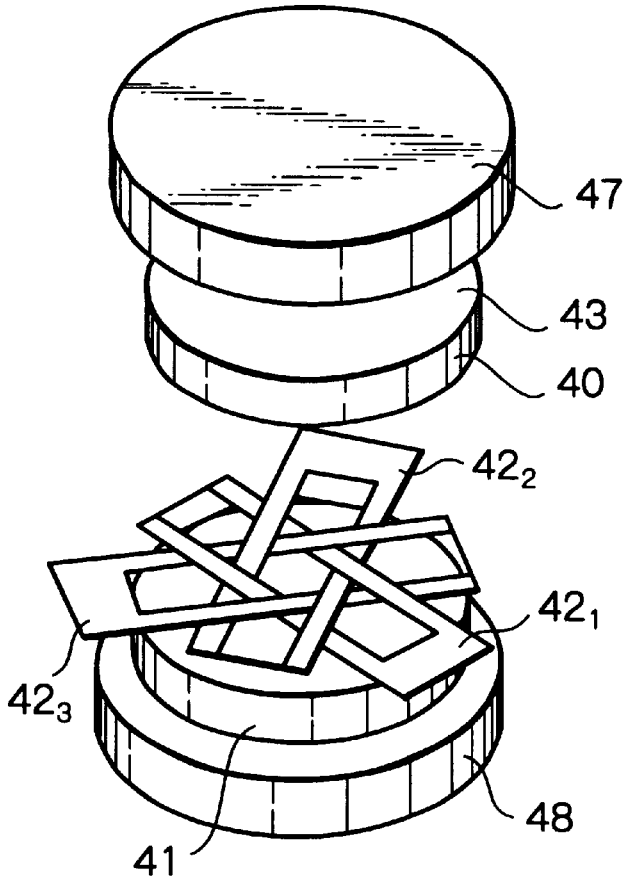
Fig. 5 PRIOR ART
FIG. 5 shows an exploded oblique view illustrating a structure of a circulator element part of the conventional lumped element circulator.
Figure 6:
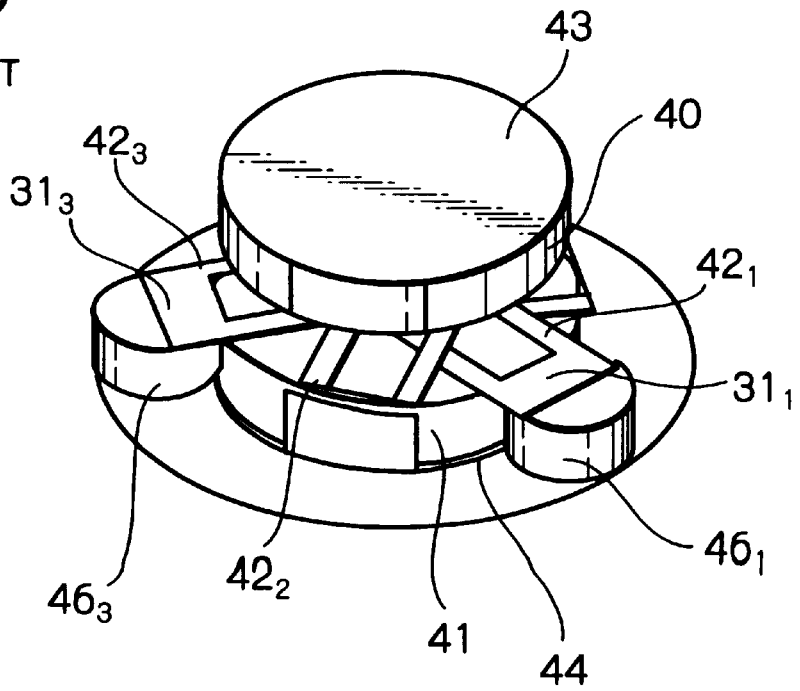
Fig. 6 PRIOR ART
FIG. 6 shows an oblique view illustrating an assembled structure in which resonance capacitors are connected to the circulator element shown in FIG. 5.

FIGS. 4*a* and 4*b* illustrate a structure of an inductor part of the conventional lumped element circulator, FIG. 5 illustrates a structure of a circulator Element part of this conventional lumped element circulator, and FIG. 6 illustrates an assembled structure in which resonance capacitors are connected to the circulator element shown in FIG. 5.

As will be apparent from these figures, the structure of the circulator element part of this conventional lumped element circulator is the same as that of the lumped element circulator of the embodiment shown in FIG. 1.

Namely, integrated ferromagnetic material disks 40 and 41 sandwich three pairs of two parallel drive conductors $\mathbf{42}_1$, $\mathbf{42}_2$ and $\mathbf{42}_3$ which are insulated from each other. Shielding electrodes 43 and 44 are formed on outer surfaces of the respective ferromagnetic material disks 40 and 41. The drive conductor pairs $\mathbf{42}_1$, $\mathbf{42}_2$ and $\mathbf{42}_3$ constitute three inductors which extend to three directions 120 degrees apart and form a trigonally symmetric shape. Resonance capacitors $\mathbf{46}_1$, $\mathbf{46}_2$ and $\mathbf{46}_3$ are connected between signal ports $\mathbf{31}_1$, $\mathbf{31}_2$ and $\mathbf{31}_3$ of the drive conductor pairs $\mathbf{42}_1$, $\mathbf{42}_2$ and $\mathbf{42}_3$, respectively. Excitation permanent magnets 47 and 48 are provided on the element 40 and under the element 41, respectively.

In FIG. 4*a*, a section of the inductor (drive conductor $\mathbf{42}_1$) connected to one signal port (signal port $\mathbf{31}_1$ for example) and excited magnetic fields are illustrated. Suppose that inductance of this inductor (drive conductor pair $\mathbf{42}_1$) is $L_0$, magnetic field 49 excited by current flowing through the remaining two inductors (drive conductor pairs $\mathbf{42}_2$ and $\mathbf{42}_3$) will cross the inductor $\mathbf{42}_1$ connected to the signal port $\mathbf{31}_1$. Thus, inductance viewed from this signal port $\mathbf{31}_1$ has to be calculated in consideration of the influence of the magnetic field 49.

In a n-ports circuit, reflection coefficients of respective signal ports can be equalized with each other by applying specially combined advance waves to the respective signal ports. Vectors indicating the advance waves which satisfy this condition are called as eigenvectors, and the reflection coefficients are called as eigenvalues. In the n-ports circuit, n eigenvectors and n eigenvalues corresponding to the respective vectors are existed. Therefore, in the three ports circulator, three eigenvectors $u_1$, $u_2$ and $u_3$ and three eigenvalues $s_1$, $s_2$ and $s_3$ corresponding to the respective vectors are existed. These eigenvectors should have the following values.

$$\vec{u}_1 = \frac{1}{3}\begin{pmatrix}1\\1\\1\end{pmatrix}, \vec{u}_2 = \frac{1}{3}\begin{pmatrix}1\\e^{-j\frac{2\pi}{3}}\\e^{j\frac{2\pi}{3}}\end{pmatrix}, \vec{u}_3 = \frac{1}{3}\begin{pmatrix}1\\e^{j\frac{2\pi}{3}}\\e^{-j\frac{2\pi}{3}}\end{pmatrix} \tag{1}$$

$$s_2 = s_1 e^{j\frac{2\pi}{3}}, s_3 = s_1 e^{-j\frac{2\pi}{3}}$$

Admittances $y_1$, $y_2$ and $y_3$ with respect to these reflection coefficients are given as following equation (2);

$$y_i = Y_c \frac{1 - s_i}{1 + s_i}, \quad [i = 1, 2, 3] \tag{2}$$

where $Y_c$ is the terminal admittance of each port.

Figure 7:
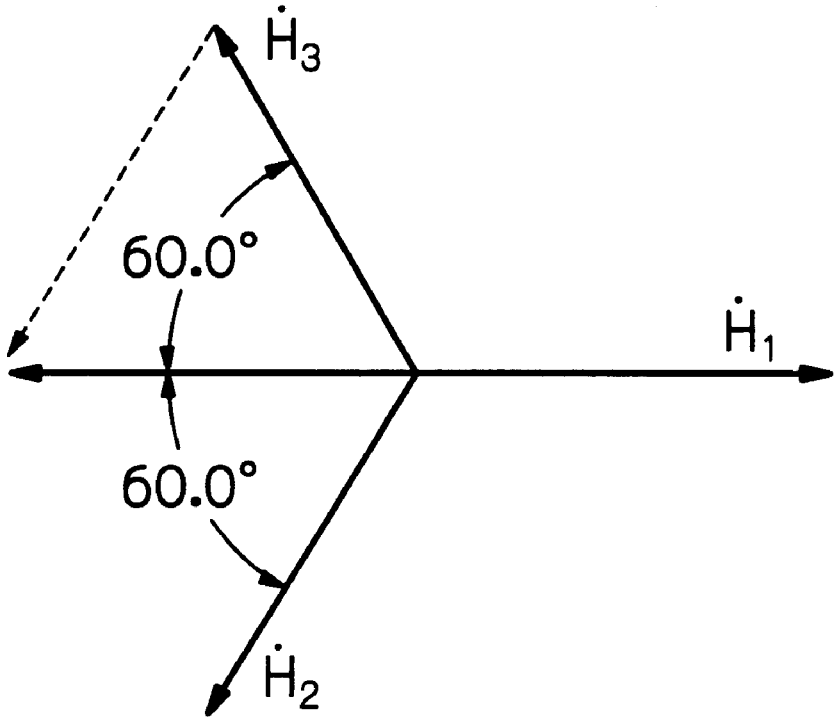
FIG. 7 illustrates magnetic field intensity when current flows through each signal port.

In case that the magnetic field $H_1$ excited by current $j_1$ flowed into the signal port $\mathbf{31}_1$ of the conventional lumped element circulator shown in FIGS. 3 to 6 is as indicated by the dotted line arrow 49 in FIG. 4*b*, the magnetic fields $H_2$ and $H_3$ excited by currents $j_2$ and $j_3$ flowed into the ports $\mathbf{31}_2$ and $\mathbf{31}_3$ respectively are represented, by using $H_1$ as a reference, as shown in FIG. 7. Thus, it is apparent that $H_1$ direction components of the magnetic fields $H_2$ and $H_3$ are represented as;

$$-\dot{H}_2\cos\frac{\pi}{3} = -\frac{1}{2}\dot{H}_2 \qquad (3)$$
$$-\dot{H}_3\cos\frac{\pi}{3} = -\frac{1}{2}\dot{H}_3$$

and then, by adding the magnetic field $H_1$, the magnetic field H is represented by following equation (4).

$$H = \dot{H}_1 - \frac{1}{2}(\dot{H}_2 + \dot{H}_3) \qquad (4)$$

Thus, excitation magnetic fields $H^1$, $H^2$ and $H^3$ for the respective eigenvectors $u_1$, $u_2$ and $u_3$ are obtained by following equations (5);

$$H^1 = \dot{H}_1 - \frac{1}{2}(\dot{H}_1 + \dot{H}_1) = 0 \qquad (5)$$
$$H^2 = \dot{H}_1 - \frac{1}{2}\left(e^{-j\frac{2\pi}{3}}\dot{H}_1 + e^{j\frac{2\pi}{3}}\dot{H}_1\right) = \frac{3}{2}\dot{H}_1$$
$$H^3 = \dot{H}_1 - \frac{1}{2}\left(e^{-j\frac{2\pi}{3}}\dot{H}_1 + e^{j\frac{2\pi}{3}}\dot{H}_1\right) = \frac{3}{2}\dot{H}_1$$

therefore, inductances of the conductors viewed from the respective signal ports $L_1$, $L_2$ and $L_3$ for the eigenvectors $u_1$, $u_2$ and $u_3$ are given as following equation (6);

$$L_1 = 0,\ L_2 = L_3 = \frac{3}{2}L_0 \equiv \xi \qquad (6)$$

where $L_0$ is the inductance of the shorten end two parallel conductors connected to one signal port when another conductors are open at end behalf of shorten.

The loading admittances of the ferromagnetic material disk or the ferrite, in other words the admittances of the part of the inductor $y_{L1}$, $y_{L2}$ and $y_{L3}$ for the eigenvectors $u_1$, $u_2$ and $u_3$ are therefore given as following equation (7);

$$y_{L1} = \infty \qquad (7)$$
$$y_{L2} = \frac{1}{j\omega\xi\mu_+}$$
$$y_{L3} = \frac{1}{j\omega\xi\mu_-}$$

where $\mu_+$ and $\mu_-$ are the positive and the negative polarized relative permeabilities. It is to be noted that the magnetic filed for exciting the eigenvectors $u_2$ and $u_3$ become the positive and negative rotational magnetic fields with respect to the externally applied D.C. magnetic field. The values $\mu_+$ and $\mu_-$ are obtained by Polder's equation as following equation (8);

$$\mu_\pm = 1 + \frac{P}{\sigma \mp 1} \qquad (8)$$
$$P = \frac{|\gamma|4\pi M_s}{\omega},$$
$$\sigma = \frac{|\gamma|H_i}{\omega}$$

where $4\pi M_s$ is the saturation magnetization of the ferrite, $H_i$ is the internal D.C. magnetic field in the ferrite, and $\gamma$ is the gyromagnetic constance. By using the equation (8), following equation (9) can be obtained.

$$\frac{1}{\mu_-} - \frac{1}{\mu_+} = \frac{\sigma+1}{\sigma+1+P} - \frac{\sigma+1}{\sigma-1+P} = \frac{2P}{(\sigma+P)^2-1} \qquad (9)$$

When it is operated under a magnetic field which is higher than the ferromagnetic resonance field (under above-resonance operation), for example operated in the lumped element circulator, there is a relationship of $(\sigma+P)^2 >> 1$. Therefore, in this case, the equation (9) can be made approximations as follows.

$$\frac{1}{\mu_-} - \frac{1}{\mu_+} \doteqdot \frac{2\omega|\gamma|4\pi M_s}{|\gamma|^2(H_i+4\pi M_s)^2} = \frac{8\omega\pi M_s}{|\gamma|(H_i+4\pi M_s)^2} \qquad (10)$$

Figure 8:
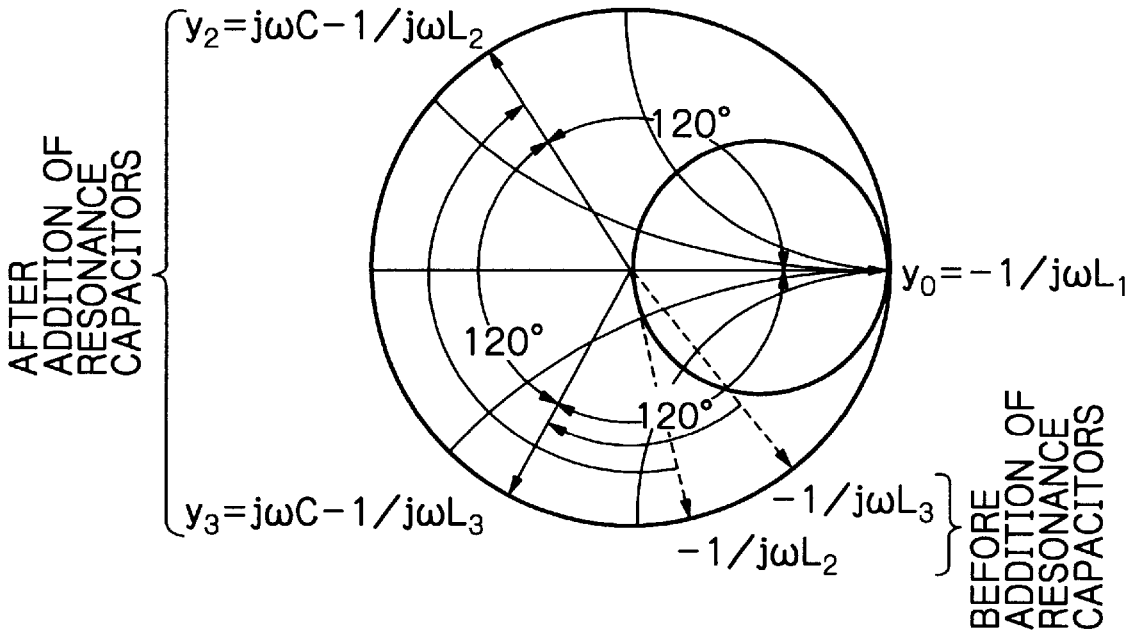
FIG. 8 shows a Smith chart illustrating variations of eigenvalues by connecting the resonance capacitors to satisfy the circulator conditions.

As a result, a value of $(1/j\omega\xi\mu_+)-(1/j\omega\xi\mu_-)$ can be obtained by following equation (11);

$$\frac{1}{j\omega\xi\mu_-} - \frac{1}{j\omega\xi\mu_+} = y_{L3} - y_{L2} = \frac{8\pi M_s}{j\xi|\gamma|(H_i+4\pi M_s)^2} \qquad (11)$$

where the value of $j(y_{L2}-y_{L3})$ is not related to frequency. This result suggests that the difference between the eigenvalues $s_2$ and $s_3$ in the circulator under excitation of the eigenvectors $u_2$ and $u_3$ is independent to frequency. In the lumped element circulator, the inductance $L_1$ for the eigenvector $u_1$ is 0 as indicated in the equation (6). Thus, the eigenvalue $s_1$ is located at the right end point (1,0) on the Smith chart and independent to frequency. Therefore, after the applied magnetic field is adjusted so that the eigenvalues $s_2$ and $s_3$ have 120 degrees apart from each other on the Smith chart, if the position of the eigenvalues $s_2$ and $s_3$ are moved by adding capacitors to the respect signal ports so that the angle of each of the eigenvalues $s_2$ and $s_3$ with respect to the eigenvalue $s_1$ becomes 120 degrees as shown in FIG. 8, a complete circulator at that frequency can be obtained.

In order to realize a circulator, it is necessary for the lumped element circulator that the eigenvalues $s_2$ and $s_3$ have to satisfy following equation (12) derived from the conditions of the eigenvalue $s_1$ expressed by the equation (7) with reference to the equation (1).

$$s_1 = -1,\ s_2 = e^{-j\frac{\pi}{3}},\ s_3 = e^{j\frac{\pi}{3}} \qquad (12)$$

Eigenadmittances satisfying this condition are given as following equation (13).

$$y_1 = \infty,\ y_2 = -j\frac{Y_c}{\sqrt{3}},\ y_3 = j\frac{Y_c}{\sqrt{3}} \tag{13}$$

Thus, $$y_3 - y_2 = j\frac{2Y_c}{\sqrt{3}} \tag{14}$$

is given. Substituting this equation (14) into the equation (11), following equation (15) is obtained.

$$\xi = \frac{4\sqrt{3}\pi M_s Z_c}{|\gamma|(H_i + 4\pi M_s)^2} \tag{15}$$

Figure 9:
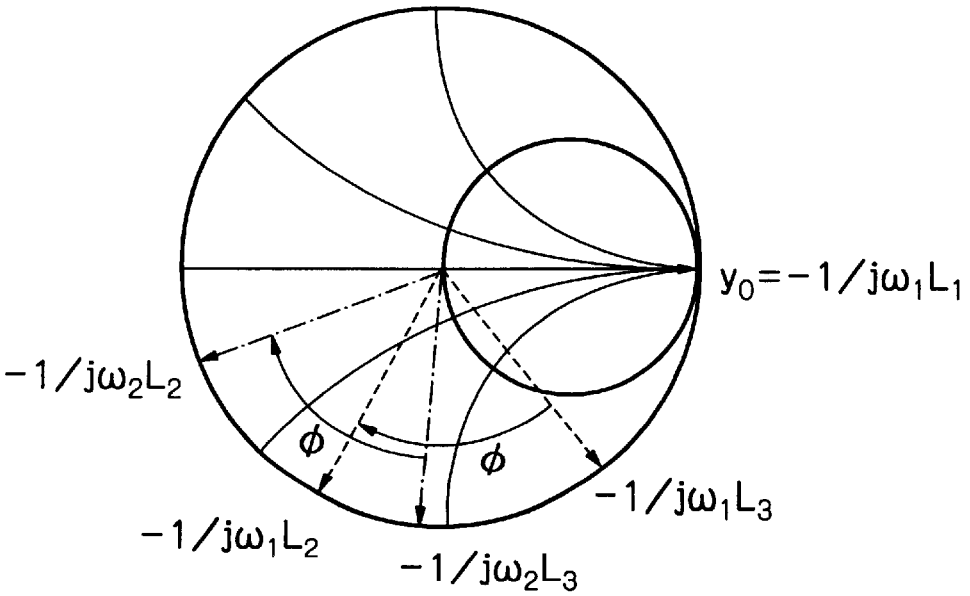
FIG. 9 shows a Smith chart illustrating that $y_3-y_2$ is independent of frequency.

It should be noted from the equation (13) that the circulator has to satisfy $y_2+y_3=0$. This is equivalent to that, as shown in FIG. 9, the admittances on the Smith chart are replaced as $y_{L2}\rightarrow y_2$ and $y_{L3}\rightarrow y_3$ with keeping the relation of the equation (14) to satisfy the circulator conditions by adding resonance capacitors to the signal ports, respectively. Therefore, the condition of $(y_2+y_3)/2=\omega C$ should be held. This condition can be obtained as follows by using the equation (8) and the above-resonance operation conditions of $\sigma^2$, $\sigma P>>1$.

$$\begin{aligned}\frac{y_{L3}+y_{L2}}{2} &= \frac{1}{j2\omega\xi}\left(\frac{1}{\mu_-}+\frac{1}{\mu_+}\right)\\ &= \frac{\sigma^2-1}{j\omega\xi(\sigma^2-1+\sigma P)}\\ &\doteqdot \frac{\sigma}{j\omega\xi(\sigma+P)}\\ &= \omega C\end{aligned} \tag{16}$$

As a result, the capacitance C can be obtained by following equation (17).

$$C = \frac{\sigma}{\omega^2\xi(\sigma+P)} = \frac{H_i}{\omega^2\xi(H_i+4\pi M_s)} \tag{17}$$

If a resonance capacitor with the capacitance C which is inversely proportional to $\omega^2$ is connected to each port, it is possible to obtain a circulator. In other words, if a circuit exhibiting a required effective capacitance at required frequencies is connected each port of the circulator element, a desired circulator having a plurality of operating frequency bands can be realized.

Suppose that a circulator is realized by connecting a circuit exhibiting the capacitance C at the frequency $f_1$ to each port. A circulator operating at both frequencies $f_1$ and $f_2$ can be obtained by connecting to each port of this circulator a circuit exhibiting a capacitance C at the frequency $f_1$ and also exhibiting a capacitance $(f_1/f_2)^2C$ at the frequency $f_2$.

Figure 10:
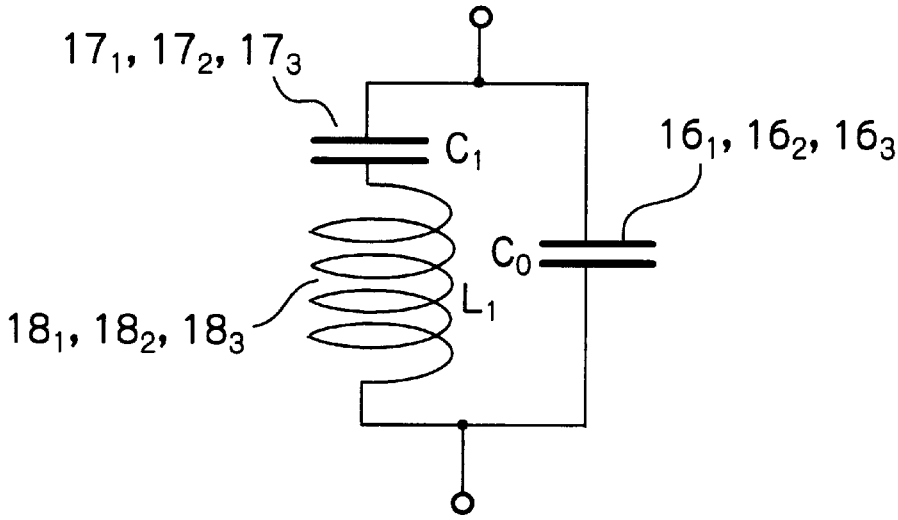
FIG. 10 shows a circuit diagram illustrating a resonance circuit connected to each port of the lumped element circulator of the embodiment shown in FIG. 1.
Figure 11:
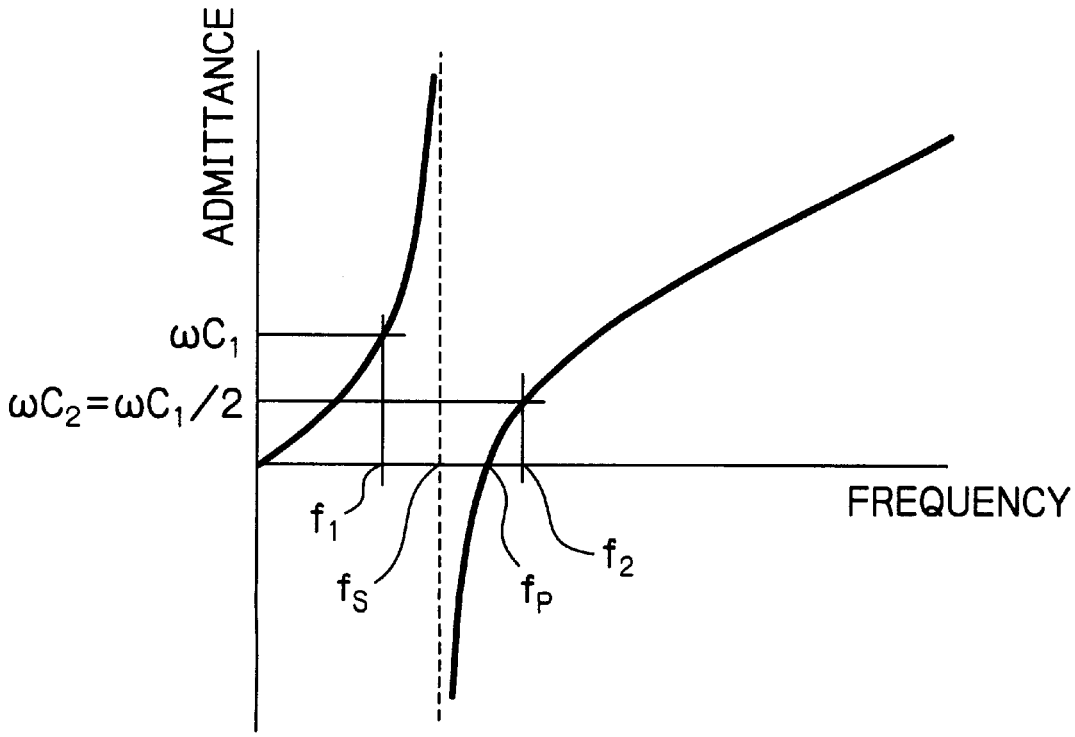
FIG. 11 illustrates frequency-admittance characteristics of the resonance circuit shown in FIG. 10.

A series-parallel resonance circuit shown in FIG. 10 is capacitive under and above the resonance frequency. Thus, if the operating frequencies of this circuit are adjusted at frequencies under and above its series-parallel resonance frequency, this circuit will meet the above-mentioned condition. An admittance y of this series-parallel resonance circuit is given as;

$$y = j\omega C_0 + \frac{1}{j\omega L_1 - \frac{1}{j\omega C_1}} \tag{18}$$

which is expressed as the frequency-admittance characteristics shown in FIG. 11. This equation (18) can be rewritten as;

$$y = \frac{\omega C_0(\omega_p^2-\omega^2)}{\omega_s^2-\omega^2} \tag{19}$$

where $\omega_s$ and $\omega_p$ are angular frequencies of the series resonance and the parallel resonance, respectively, and $$\omega_s^2 = \frac{1}{L_1C_1},\quad \omega_p^2 = \omega_s^2\left(1+\frac{C_1}{C_0}\right)$$

In the case of $f_2=2f_1$, a necessary capacitance is C/4 and therefore the admittances at the frequencies $f_1$ and $f_2$ are expressed as $\omega_1C$ and $\omega_2C=\omega_1C/2$, respectively. Substituting these conditions into the equation (19), following equations are obtained.

$$\begin{aligned}\omega_1 C &= \frac{\omega C_0(\omega_p^2-\omega^2)}{\omega_s^2-\omega^2}\\ \frac{\omega_1 C}{2} &= \frac{\omega C_0(\omega_p^2-\omega^2)}{\omega_s^2-\omega^2}\end{aligned} \tag{20}$$

Since the number of unknowns is more than the number of equations in the equation (20), some constants in the equation can be arbitrarily determined. If x and y are expressed as;

$$x = \frac{\omega_s}{\omega_1},\quad y = \frac{\omega_p}{\omega_1}$$

in case of $f_2=2f_1$, y is given by following equation (21).

$$y = \sqrt{5-\frac{4}{x^2}} \tag{21}$$

The x and y are restricted as $1<x<2$ and $1<y<2$ because of the predetermined relation between the operation frequencies and, as will be apparent from FIG. 11, the solution will be unstable when x approaches 1 or y approaches 2. By determining y after x is determined to an appropriate value, $C_0$, $C_1$ and $L_1$ can be obtained from the equation (20) as follows.

$$\begin{aligned}C_0 &= C\frac{x^2-1}{y^2-1}\\ C_1 &= C_0\left\{\frac{y^2}{x^2}-1\right\} = C\frac{x^2-1}{y^2-1}\left\{\frac{y^2}{x^2}-1\right\}\\ L_1 &= \frac{1}{\omega_s\cdot C_1} = \frac{1}{(x\cdot\omega_1)^2\cdot C_1}\end{aligned} \tag{22}$$

A dual band lumped element circulator according to this embodiment is practically designed and fabricated. To design the circulator, when we choose values of $4\pi M_3=400$ Gauss, $f_1$=300 MHz, σ=3.5 and Zc=50Ω, P, ωξ and ξ are calculated as follows.

$$P = \frac{2.8 \times 450}{300} = 4.20$$

$$\omega\xi = \frac{\sqrt{3} \times 4.20 \times 50}{(3.50 + 4.20)^2} = 6.13\ (\Omega)$$

$$\xi = 3.25(\text{nH})$$

Thus, the resonance capacitance C can be obtained by using the equation (17) as follows.

$$C = \frac{3.5}{(2\pi \times 300 \times 10^6)^2 \times 3.25 \times 10^{-9} \times (3.5 + 4.20)} = 39.3\ (\text{pF})$$

A circulator element which satisfies this condition is fabricated and thus a dual band lumped element circulator operable at octave frequencies of 300 MHz and 600 MHz is formed. Circuit constants of the resonance capacitance circuit connected to each port of the circulator instead of the conventional capacitor are determined with reference to the equation (22) as follows.

$$C_0 = 39.3 \times \frac{1.30^2 - 1}{1.62^2 - 1} = 16.7\ (\text{pF})$$

$$C_1 = 16.7 \times \left(\frac{1.62^2}{1.30^2} - 1\right) = 9.2\ (\text{pF})$$

$$f_s = 1.30 \times 300 = 390(\text{MHz})$$

$$L_1 = \frac{1}{(2\pi \times 390 \times 10^6)^2 \times 9.2 \times 10^{-12}} = 18.0\ (\text{nH})$$

Figure 12:
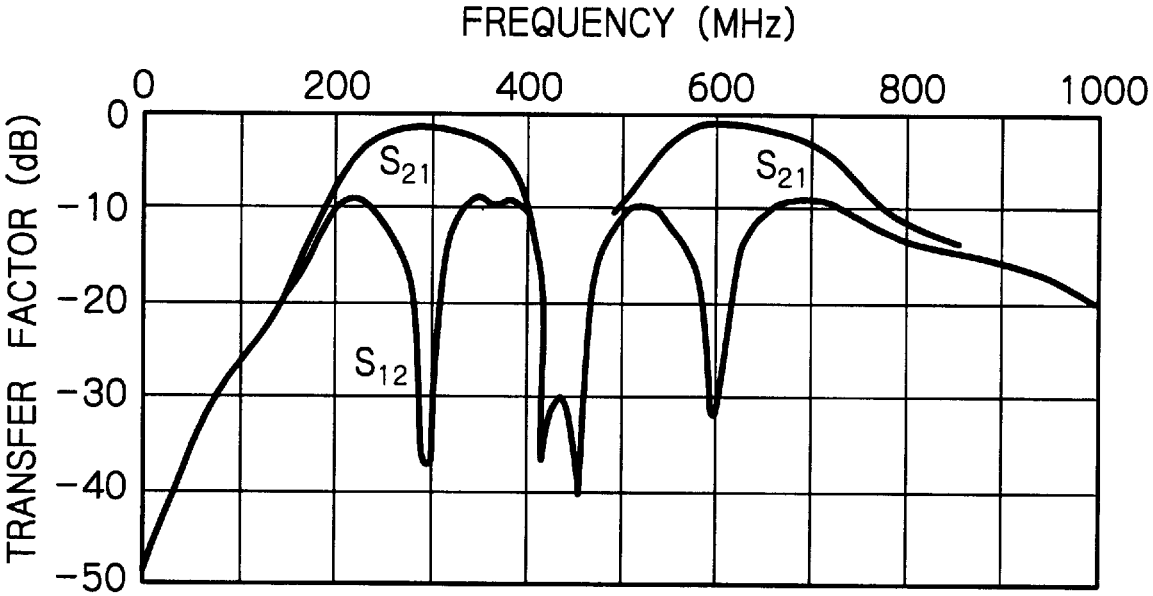
FIG. 12 illustrates transfer characteristics of a dual band lumped element circulator actually designed and fabricated.

The dual band circulator thus fabricated has a transfer characteristics as shown in FIG. 12. As will be understood from the figure, this measured transfer characteristics matches with the designed characteristics very well.

The aforementioned embodiment concerns a dual band circulator with two operation bands. It is known however that in a two-terminal resonance circuit with a plurality of resonance points, capacitive regions can be made by the number equal to the number of its resonance point pairs plus one. Therefore, it is apparent that a circulator with three or more operation bands at desired frequencies can be constructed by modifying the aforementioned embodiment.

Figure 13:
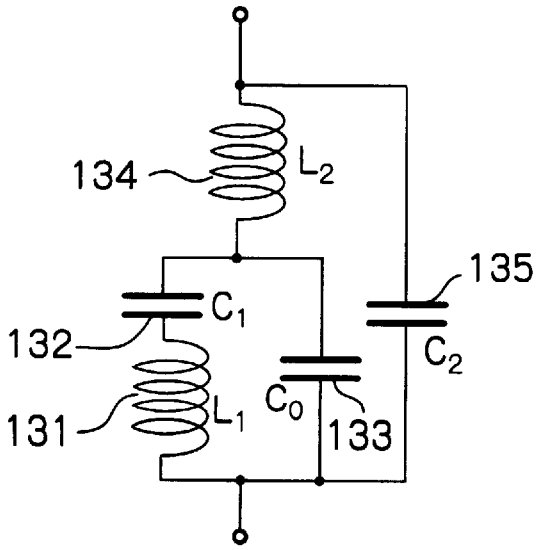
FIG. 13 shows a circuit diagram illustrating each of resonance circuits connected to a lumped element circulator of another embodiment according to the present invention.

FIG. 13 illustrates a resonance circuit connected to each port of a lumped element circulator of another embodiment according to the present invention.

As shown in the figure, this series-parallel resonance circuit has a series resonance circuit constituted by a resonance coil 131 with an inductance $L_1$ and a resonance capacitor 132 with a capacitance $C_1$ connected in series, a resonance capacitor 133 with a capacitance $C_0$ connected in parallel with the series resonance circuit, a resonance coil 134 with an inductance $L_2$ connected in series with the series resonance circuit, and a resonance capacitor 135 with a capacitance $C_2$ connected in parallel with the resonance coil 134 and the series resonance circuit. This two-terminal series-parallel resonance circuit is connected between each signal port and the grounded electrode of the circulator as well as the aforementioned embodiment.

This series-parallel resonance circuit has two pairs of series resonance point and parallel resonance point, and therefore is used for a circulator which requires three operation bands.

Many widely different embodiments of the present invention may be constructed without departing from the spirit and scope of the present invention. It should be understood that the present invention is not limited to the specific embodiments described in the specification, except as defined in the appended claims.

What is claimed is:

1. A lumped element circulator to be biased by a dc magnetic field and having a plurality of separated operation bands, comprising:

a circulator element comprising a ferrite disc, a plurality of intersecting conductors having respective signal ports and a grounded terminal; and resonance circuits connected between said signal ports and said grounded terminal, respectively, each of said resonance circuits having a plurality of resonance points, the number of said operation bands being equal to the number of said resonance points of each of the resonance circuits, wherein said resonance circuits operate as capacitors within each of said operation bands.

2. The circulator as claimed in claim 1, wherein each of said resonance circuits is a series-parallel resonance circuit having at least one pair of a series resonance point and a parallel resonance point.

3. The circulator as claimed in claim 2, wherein the number of said operation bands is equal to the number of the pair of the series resonance point and the parallel resonance point plus one.

* * * * *